US007476053B2

(12) United States Patent
Face, III et al.

(10) Patent No.: US 7,476,053 B2
(45) Date of Patent: Jan. 13, 2009

(54) PORTABLE FORM AND METHOD FOR USING SAME FOR CONCRETE STRIKE-OFF

(75) Inventors: S. Allen Face, III, Wilmington, NC (US); Albert D. Frankeny, II, Round Hill, VA (US)

(73) Assignee: Laser Strike, LLC, Wilmington, NC (US)

( * ) Notice: Subject to any disclaimer, the term of this patent is extended or adjusted under 35 U.S.C. 154(b) by 263 days.

(21) Appl. No.: 11/497,221

(22) Filed: Aug. 1, 2006

(65) Prior Publication Data

US 2008/0031689 A1 Feb. 7, 2008

(51) Int. Cl.
*E01C 19/22* (2006.01)

(52) U.S. Cl. ..... 404/118; 404/72; 404/112

(58) Field of Classification Search ..... 404/112–114, 404/118, 119, 72, 75
See application file for complete search history.

(56) References Cited

U.S. PATENT DOCUMENTS

| | | | | |
|---|---|---|---|---|
| 2,155,571 | A * | 4/1939 | Tullis | 15/235.8 |
| 4,298,555 | A * | 11/1981 | Weltmer | 264/31 |
| 4,795,332 | A * | 1/1989 | Davis | 425/60 |
| 5,533,831 | A * | 7/1996 | Allen | 404/114 |
| 6,223,495 | B1 * | 5/2001 | Shaw et al. | 52/749.1 |
| 6,758,631 | B2 * | 7/2004 | Frankeny, II | 404/118 |

* cited by examiner

*Primary Examiner*—Raymond W Addie
(74) *Attorney, Agent, or Firm*—Peter J. Van Bergen

(57) ABSTRACT

A form for concrete strike-off has a rigid straightedge assembly and a support coupled to one end of the straightedge assembly. The straightedge assembly includes a grate coupled to the bottom edge of a support bar. The grate extends away from the support bar with a top surface of the grate defining a plane on at least one side of the support bar. In use, a portion of the straightedge assembly defines a reference elevation for concrete strike-off operations.

13 Claims, 4 Drawing Sheets

PORTABLE FORM AND METHOD FOR USING SAME FOR CONCRETE STRIKE-OFF

CROSS-REFERENCE TO RELATED PATENT APPLICATIONS

This patent application is co-pending with one related patent application entitled "PORTABLE FORM AND METHOD FOR USING SAME FOR CONCRETE STRIKE-OFF", Ser. No. 11/335,227, filed Jan. 19, 2006, owned by the same assignee as this patent application.

FIELD OF THE INVENTION

The invention relates generally to concrete strike-off tools and methods, and more particularly to a portable apparatus that can be used to define a form for concrete strike-off operations and a method for using the apparatus.

BACKGROUND OF THE INVENTION

In concrete slab construction, the manual striking off of wet or plastic concrete is a labor intensive process that generally consists of three steps, the first of which will differ according to the desired elevation of the finished concrete surface. For example, if the finished surface is intended to parallel the base over which the concrete is being placed (thereby resulting in a slab of constant thickness), then the wet concrete surface at various small isolated spots is first struck off to its intended finished elevation by measuring up from the base using a gage stick equal in length to the desired finished slab thickness. If, however, the finished surface is not necessarily intended to be constant thickness, but is instead intended merely to be planar, then the wet concrete surface at various small isolated spots is first struck off to its intended finished elevation by using an optical or laser level and grade stick to define the desired plane. In both of these above-described cases, the small isolated reference spots that are initially formed in the wet concrete surface are termed "wet pads". To facilitate subsequent strike-off operations, the distances between adjacent wet pads are kept somewhat shorter than the length of the straightedge that is to be used to strike off the bulk of the concrete.

The second step in a manual strike-off operation involves using the straightedge and two adjacent wet pads as elevation references. The concrete between the wet pads is struck off to create a narrow, elongated section of at-grade concrete that is termed a "wet screed". Again, to facilitate subsequent strike-off operations, the wet screeds are generally made to parallel one another at spacings somewhat shorter than the length of the straightedge.

The last step in a manual strike-off operation involves using the straightedge and two adjacent wet screeds as elevation references to strike off the concrete between the wet screeds to grade. However, owing to the plastic, unstable character of the wet pads and wet screeds that are used to control the elevation of the straightedge, the finished surfaces produced by this so-called "wet screed" method of concrete slab construction typically exhibit poor conformity to the desired grade.

The above described process is greatly improved upon by use of the portable form disclosed in the previously-referenced U.S. patent application Ser. No. 11/355,227. Briefly, a pan adapted to float on a plastic or wet concrete surface has a rigid straightedge coupled thereto. More specifically, the straightedge has first and second ends opposing one another along a longitudinal dimension thereof. The first end is adjustably coupled to the pan such that the first end can at least be rotated relative to the pan. A support is coupled to the second end of the straightedge with the straightedge thereby defining a reference elevation for concrete strike-off operations. After being used to strike off an area of the concrete, the support is raised and used as a handle to reposition the form as the pan skis on top of the wet concrete to a new location. Since the time associated with the drying or stiffening of wet concrete varies greatly, there may be some situations where the pan is resting on stiffened concrete that has substantially lost its plasticity. In these situations, it has been found that the operator will frequently just pick up the entire form and place it at the next location. However, the extra weight and movement of the pan increases the effort required to reposition the form in this fashion.

SUMMARY OF THE INVENTION

Accordingly, it is an object of the present invention to provide an apparatus and method of using same that simplifies the positioning of a temporary and rigid reference form during strike-off of a wet concrete slab adjacent to concrete that has substantially lost its plasticity.

Other objects and advantages of the present invention will become more obvious hereinafter in the specification and drawings.

In accordance with the present invention, a form for concrete strike-off is provided. A rigid straightedge assembly has first and second ends opposing one another along a longitudinal dimension thereof. A support is coupled to the second end of the straightedge assembly with a portion of the straightedge assembly defining a reference elevation for concrete strike-off operations. The straightedge assembly includes a grate coupled to the bottom edge of a support bar. The grate extends away from the support bar with a top surface of the grate defining a plane on at least one side of the support bar. In a method for using the form, the grate is positioned such that the straightedge assembly's first end is in concrete that has substantially lost its plasticity with the top surface of the grate being aligned with the surface of the concrete that has substantially lost its plasticity.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
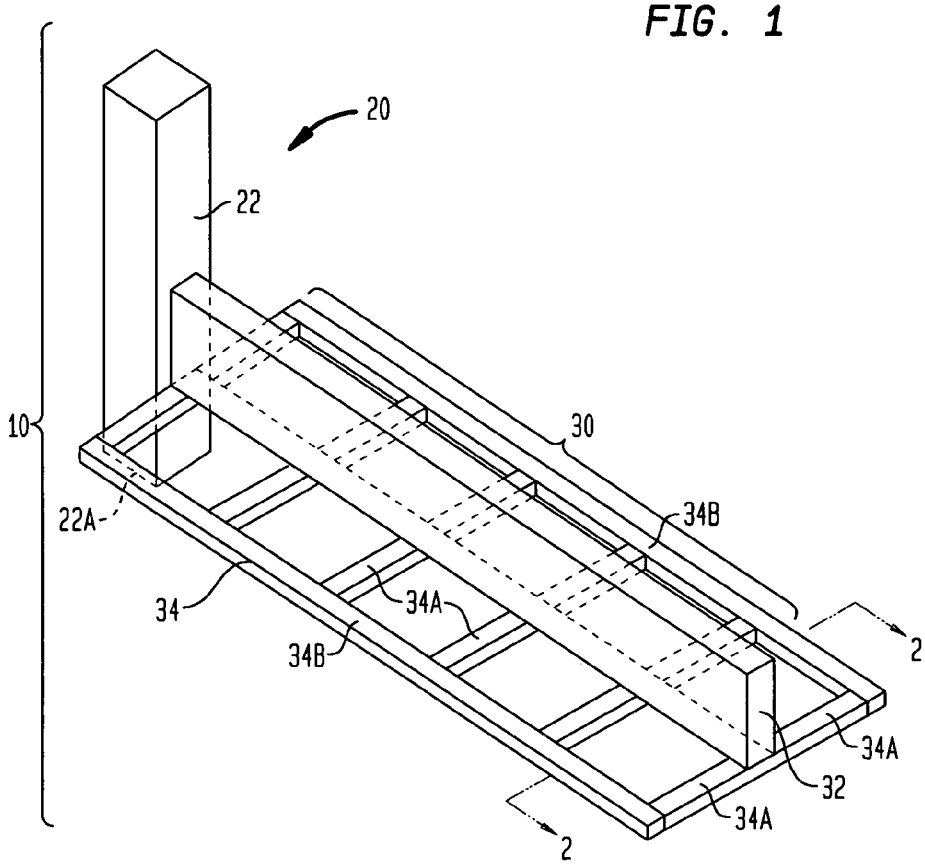
FIG. 1 is a perspective view of an apparatus that can be used to define a form used in a concrete strike-off operation in accordance with an embodiment of the present invention.
Figure 2:
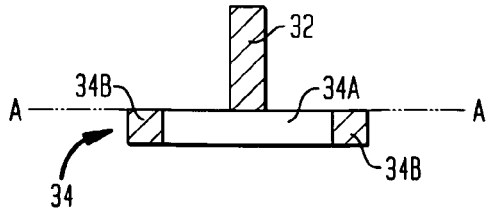
FIG. 2 is a cross-sectional view taken along line 1-1 in FIG. 1.

Referring now to the drawings, and more particularly with simultaneous reference to FIGS. 1 and 2, an apparatus for defining a form in a concrete strike-off operation in accordance with an embodiment of the present invention is shown and is referenced generally by numeral 10. Apparatus 10 includes two main assemblies that are coupled to one another. The assemblies are a support assembly 20 and a straightedge assembly 30. After reading the ensuing description of the illustrated embodiment and the use thereof, one of ordinary skill in the art will readily appreciate that the functions of each of support assembly 20 and straightedge assembly 30 could be realized by a variety of constructions without departing from the scope of the present invention. Accordingly, it is to be understood that the illustrated embodiment is presented as a non-limiting example of the present invention.

In the illustrated embodiment, support assembly 20 is a simple rigid support member 22 (e.g., wood, metal, composite, etc.) that will rest on an underlying base structure on which concrete is laid as will be explained further below. Straightedge assembly 30 is coupled to support member 22 and extends perpendicularly away therefrom at a height above the bottom 22A of support member 22. In the illustrated embodiment, the height above bottom 22A is fixed. However, as will be shown in later embodiments, the height of straightedge assembly 30 relative to bottom 22A can be adjustable.

Straightedge assembly 30 includes a straight and rigid bar 32 with a rigid grate 34 coupled to and supported from the bottom edge of bar 32 along the length thereof. Bar 32 can be solid (as shown) or hollow without departing from the scope of the present invention. The cross-sectional shape of bar 32 can be rectangular (as shown) or other geometric shapes (e.g., round, triangular, etc.) without departing from the scope of the present invention.

Figure 3A:
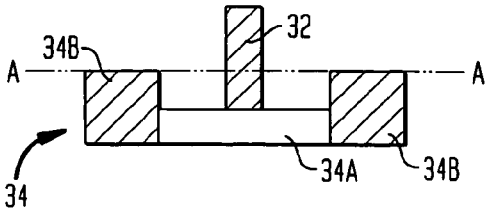
FIG. 3A is a cross-sectional view of another embodiment of the present invention's grate that is coupled to the straightedge assembly.
Figure 3B:
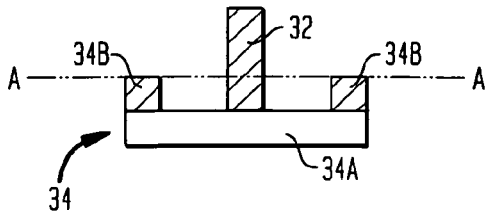
FIG. 3B is a cross-sectional view of another embodiment of the present invention's grate that is coupled to the straightedge assembly.

Grate 34 is defined generally by spaced-apart cross-pieces 34A and longitudinal pieces 34B, the cross-sectional shapes of which are not limitations on the present invention. In the illustrated embodiment, cross-pieces 34A are identically-sized and extend transversely away from either side of bar 32 such that the outboard ends of cross-pieces 34A are aligned on either side of bar 32. Each longitudinal piece 34B is rigidly coupled to the outboard ends of cross-pieces 34A. The cross-sectional size/shape of longitudinal pieces 34B can be such that the top thereof aligns with the tops of cross-pieces 34A so that the top surface of grate 34 defines a plane A-A as illustrated. However, the present invention is not so limited as the cross-sectional size/shape of longitudinal pieces 34B could be larger than cross-pieces 34A (as shown in FIG. 3A) so that the tops of longitudinal pieces 34B define plane A-A for grate 34. Still further, longitudinal pieces 34B could be mounted on top of cross-pieces 34A as shown in FIG. 3B.

Figure 4:
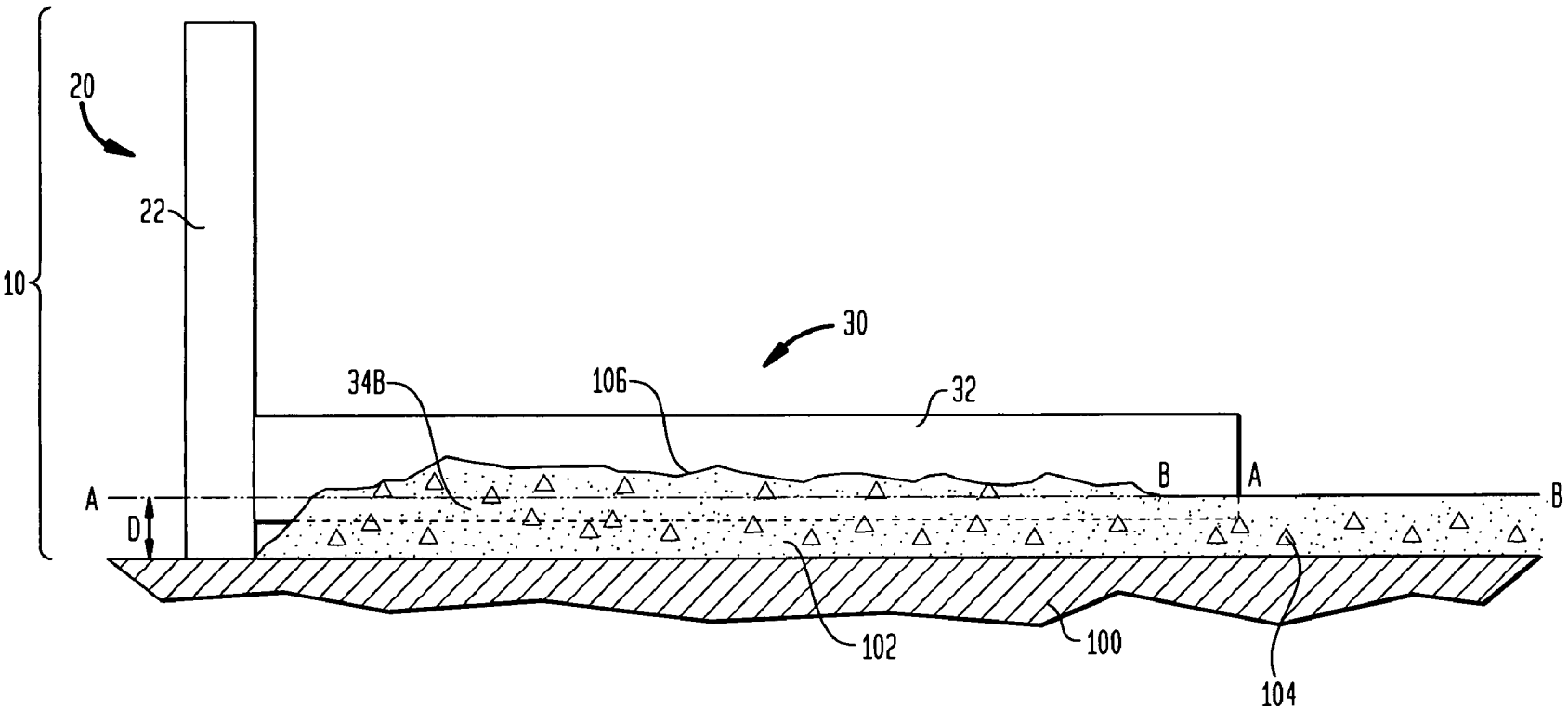
FIG. 4 is a side view of an operational set-up utilizing one form apparatus of the present invention.
Figure 5:
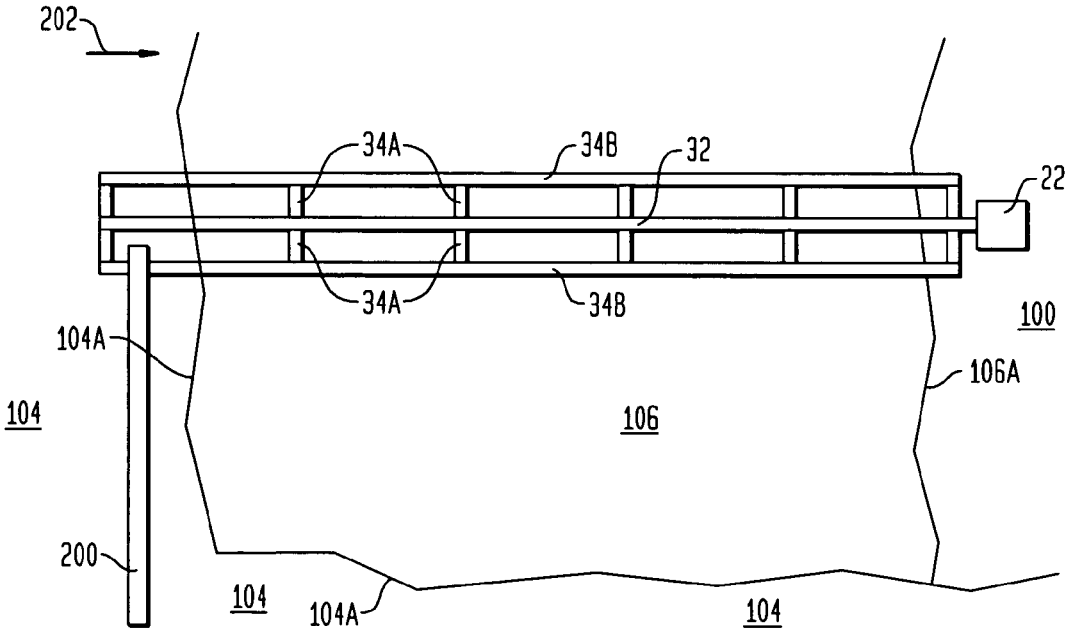
FIG. 5 is a plan view of the operational set-up utilizing one form apparatus of the present invention.

Referring now to FIGS. 4 and 5, apparatus 10 is illustrated in an operational set-up in which an underlying base structure is referenced by numeral 100, wet or plastic concrete is referenced by numeral 102, previously struck-off concrete at a desired grade B-B is referenced by numeral 104 where concrete 104 has dried sufficiently such that it has substantially lost its plasticity, and an unfinished surface of plastic concrete 102 is referenced by numeral 106. While apparatus 10 will be described for an operational set-up that uses just one apparatus 10, it is to be understood that groups of two or more of apparatus 10 could be used to set a temporary form for concrete strike-off.

As shown in FIG. 5, it will be assumed that concrete 104 has substantially lost its plasticity and is at a desired elevation (achieved during previous strike-off cycles) that extends up to finished boundaries 104A. Unfinished plastic concrete surface 106 extends between boundaries 104A up to boundary 106A at which point underlying base structure 100 is visible. As used herein, the phrase "concrete that has substantially lost its plasticity" is defined as concrete that can no longer be manipulated in bulk (as is the case with wet or plastic concrete), but is still soft enough to permit small indentations to be formed in the surface thereof.

Apparatus 10 will be used in cases where the finished concrete is required to be of constant thickness above underlying base structure 100. In this configuration, apparatus 10 can be used to strike-off wet concrete to a constant thickness D aligned with plane A-A of straightedge assembly 30. Given the above-described situation, an operator (not shown) positions apparatus 10 such that the outboard end of straightedge assembly 30 is on the surface of concrete 104 while the bottom 22A of support member 22 is positioned/rested on underlying support structure 100. The semi-soft nature of concrete 104 allows the portion of grate 34 resting thereon to sink in. However, because concrete 104 has substantially lost its plasticity, it has been found that grate 34 only sinks into concrete 104 until the top surface plane of grate 34 is aligned with the surface of concrete 104. In some cases, the operator may need to press down on straightedge assembly 30 until the top surface plane of grate 34 is aligned with the surface of concrete 104. In general, this will be achievable when the overall thickness of grate 34 is on the order of approximately one inch or less.

To strike-off unfinished concrete surface 106, the operator simply places a strike-off straightedge 200 such that it is supported on one end by the surface of concrete 104 and on the other end by the top of longitudinal piece 34B. Moving straightedge 200 in direction 202 causes unfinished surface 106 to be struck-off to the same elevation as concrete 104. The operator then picks up apparatus 10 and repositions it at the next unfinished region. This cycle can then be repeated for each unfinished region. A similar process is used when two or more of apparatus 10 are spaced apart from one another to essentially define a guide plane for straightedge 200. The process is also similarly carried out when using variable-height embodiments of the present invention that are explained further below.

Figure 6:
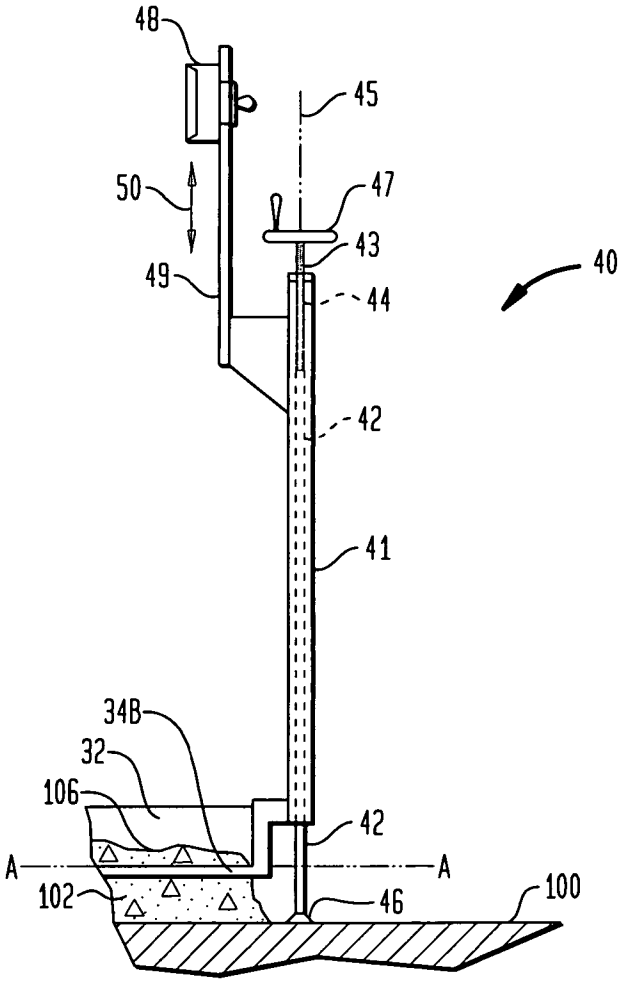
FIG. 6 is a side view of an embodiment of a variable-height support assembly to include a laser receiver assembly.

As mentioned above, the support assembly for straightedge assembly 30 can be a fixed-height assembly (e.g., support member 22) or can be a variable-height assembly. For example, as illustrated in FIG. 6, a variable-height support assembly 40 includes an open-ended outer sleeve 41 and a rod 42 that passes through the central portion of sleeve 41 and extends from either end thereof. Rod 42 is threaded at least partially therealong at 43 for threaded cooperation with mating threads 44 in sleeve 41. As a result, sleeve 41 and rod 42 share a common longitudinal axis referenced by dashed line 45. When rod 42 is rotated about longitudinal axis 45 while sleeve 41 is maintained in a non-rotating relationship, sleeve 41 moves towards one end or the other of rod 42 thereby causing the lengthening or shortening of support assembly 40. Sleeve 41 is coupled to bar 32 so that bar 32 is raised/lowered with sleeve 41.

One end of rod 42 will be positioned on underlying base structure 100. Accordingly, this end can have a swiveling foot or pad 46 coupled thereto to engage support 100 in a non-slip fashion. The opposing longitudinal end of rod 42 can have a hand crank 47 coupled thereto to facilitate the manual turning of rod 42 about longitudinal axis 45.

To facilitate the elevational setting of straightedge assembly 30, variable-height support assembly 40 can include a device/system for setting a desired height of support assembly 40 to thereby set the height of straightedge assembly 30. Such devices/systems can include manual and automated types of devices/systems. For example, height adjustment of support assembly 40 can be facilitated using a laser receiver 48 mounted to a bracket 49 that, in turn, is coupled to sleeve 41. Bracket 49 should provide for the adjustable positioning of laser receiver 48 in either direction 50 that is parallel to longitudinal axis 45. As is well understood in the art, laser receiver 48 is designed to receive a laser beam (not shown) projected in a plane in order to indicate when laser receiver 48 is "on grade" with respect to the laser beam. Before use, the position of laser receiver 48 is adjusted on bracket 49 to make the vertical distance between laser receiver 48 and top of grate 34 equal to the vertical distance between the laser beam (not shown) and the desired grade. By virtue of this set up, whenever laser receiver 48 indicates "on grade", the top of grate 34 (i.e., plane A-A) will coincide with the desired grade.

Figure 7:
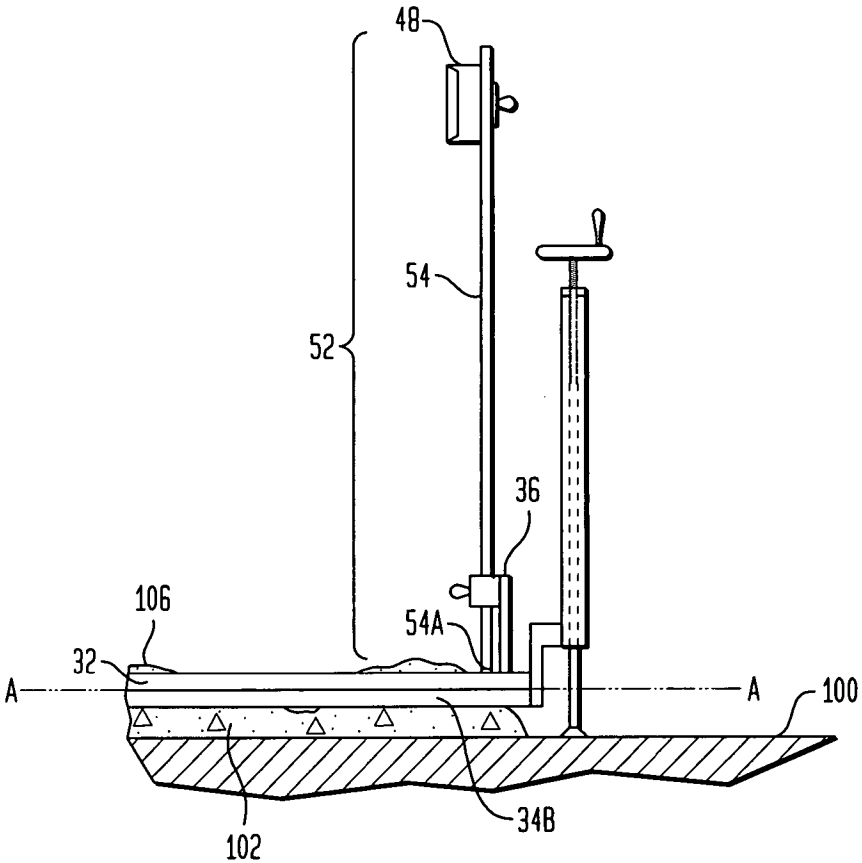
FIG. 7 is a side view of the variable-height support assembly and a laser receiver assembly coupled to the straightedge assembly.

Another option is illustrated in FIG. 7 where a holder 36 can be mounted on bar 32 to provide upright support for a removable pole and laser receiver assembly 52 resting directly on bar 32. More specifically and as would be well understood in the art, laser receiver 48 is positioned before use on a pole 54 to make the vertical distance between laser receiver 48 and the top of grate 34 equal to the vertical distance between the laser beam (not shown) and the desired grade.

The advantages of the present invention are numerous. The apparatus simplifies the placement/repositioning of the form when plastic concrete to be struck-off at a particular grade is adjacent to concrete that is already at the desired grade and that has substantially lost its plasticity. The grate's minimal invasiveness into the concrete assures that the apparatus will (i) not be interfered with by concrete-embedded obstructions such as reinforcing bar, and (ii) maintain the integrity of a struck-off surface. The apparatus can be used by itself or in concert with a multiplicity thereof to set temporary forms for a concrete strike-off operation. Since each such apparatus operates independently, each is set to provide a form at the locally desired finish grade.

Although the invention has been described relative to specific embodiments thereof, there are numerous other variations and modifications that will be readily apparent to those skilled in the art in light of the above teachings. For example, the grate attached to the underside of the support bar might only extend to one side of the support bar in order to reduce the overall weight of the apparatus. Further, the particular configuration of the grate could be other than that described herein as any configuration that minimally invades the concrete while simultaneously defining a guide plane for a strike-off straightedge will suffice. It is therefore to be understood that, within the scope of the appended claims, the invention may be practiced other than as specifically described.

What is claimed as new and desired to be secured by Letter Patent of the United States is:

1. A form for concrete strike-off, comprising:

a rigid straightedge assembly having first and second ends opposing one another along a longitudinal dimension thereof, said straightedge assembly including a rigid support bar having top and bottom edges and a grate coupled to said bottom edge and extending away therefrom wherein a top surface of said grate defines a plane on at least one side of said support bar; and a support coupled to said second end of said straightedge assembly with a portion of said straightedge assembly defining a reference elevation for concrete strike-off operations.

2. A form as in claim 1 wherein said support includes means for adjusting an elevation of said second end of said straightedge assembly.

3. A form as in claim 1 further comprising a laser receiver coupled to said second end of said straightedge assembly.

4. A form as in claim 1 further comprising a laser receiver coupled to said support.

5. A form for concrete strike-off, comprising:

a rigid support bar having first and second ends opposing one another along a longitudinal dimension thereof, said support bar further having top and bottom edges;

a grate coupled to- said bottom edge and extending away from either side of said support bar all along said longitudinal dimension thereof, wherein a top surface of said grate defines a plane on either side of said support bar; and a support coupled to said second end of said support bar.

6. A form as in claim 5 wherein said support includes means for adjusting an elevation of said second end of said support bar.

7. A form as in claim 5 further comprising a laser receiver coupled to said second end of said support bar.

8. A form as in claim 5 further comprising a laser receiver coupled to said support.

9. A method of defining a reference elevation for a concrete strike-off operation, comprising the steps of:

providing a rigid support bar having first and second ends opposing one another along a longitudinal dimension thereof with a grate being coupled to the bottom edge of said support bar all along said longitudinal dimension, wherein a top surface of said grate defines a plane on at least one side of said support bar;

positioning said grate at said first end in concrete that has substantially lost its plasticity with said top surface of said grate aligned with the surface of said concrete that has substantially lost its plasticity; and supporting said second end from a support such that said top surface of said grate defines a reference elevation for a concrete strike-off operation.

10. A method according to claim 9 wherein said reference elevation defines a concrete strike-off elevation.

11. A method according to claim 9 wherein said reference elevation is parallel to a concrete strike-off elevation.

12. A method according to claim 9 further comprising the step of adjusting the height of said second end.

13. A method according to claim 12 further comprising the step of using a laser receiver to establish the height of said second end.

* * * * *